US006730383B2

(12) United States Patent
Rawlings et al.

(10) Patent No.: US 6,730,383 B2
(45) Date of Patent: May 4, 2004

(54) DUPLEXING TIES

(75) Inventors: Timothy W. Rawlings, Waynesville, OH (US); Joseph D. Roth, Springboro, OH (US); Wayne D. Finster, Vernon, WI (US); Mitch R. Bauer, Lititz, PA (US)

(73) Assignee: NCR Corporation, Dayton, OH (US)

( * ) Notice: Subject to any disclaimer, the term of this patent is extended or adjusted under 35 U.S.C. 154(b) by 75 days.

(21) Appl. No.: 09/771,719

(22) Filed: Jan. 30, 2001

(65) Prior Publication Data

US 2002/0102378 A1 Aug. 1, 2002

(51) Int. Cl.[7] ..... G09F 3/02

(52) U.S. Cl. ..... 428/40.1; 283/67; 283/81; 283/105; 283/900; 428/41.7; 428/41.8; 428/42.1; 428/42.2; 428/42.3; 428/43; 428/138

(58) Field of Search ..... 428/40.1, 41.7, 428/41.8, 42.1, 42.2, 43, 138; 283/81, 67, 105, 900

(56) References Cited

U.S. PATENT DOCUMENTS 5,642,906 A 7/1997 Foote et al.
5,855,395 A 1/1999 Foote et al.
6,036,231 A 3/2000 Foote et al.
6,254,952 B1 * 7/2001 Fox ..... 428/40.1

OTHER PUBLICATIONS

Internet Website: PFFC, Paper, Film & Foil Converter, Jun., 2000, Tardiff, Bob.

Internet Website: http://www.iigf–films.com/Pages/$O_{13}$Liners.html, IGF, International Graphic Films, Mar., 10, 2003.

Internet Website: http://www.filmloc.com/pstutorial.html, FilmLock, Division of Sunbelt Sales & Marketing, Mar. 10, 2003.

Internet Website: Tekra, :Label Stocks Product Review.

* cited by examiner

*Primary Examiner*—Nasser Ahmad
(74) *Attorney, Agent, or Firm*—Millen, White, Zelano & Branigan PC

(57) ABSTRACT

Described are label sheets of pressure sensitive labels which are useful for duplex printing applications. The labels are provided with ties to secure them in order to lessen the adverse effects of delamination and leakage of adhesive into the printer parts. They are particularly useful for avoiding these disadvantages during duplex printing which subjects the label sheet to additional manipulation and treatment, such as two heated toner fusion steps, in contrast to simplex printing. Also described are methods of duplex printing using such label sheets.

19 Claims, 3 Drawing Sheets

DUPLEXING TIES

The present invention relates generally to pressure sensitive label sheets, useful for duplexing applications. The invention is particularly applicable for example, to Integrated, Fuse Form™, Dual Web or Full Sheet laser label sheets for duplex printing applications.

BACKGROUND OF THE INVENTION

Pressure sensitive labels are commonly available in various forms. In a typical embodiment, a label sheet includes several individually removable labels which define an overlay or face sheet adhesively bonded to a release liner. The adhesive is permanently bonded to the back of the overlay, and forms a weak bond with the liner which typically has an exposed silicone surface permitting individual label removal therefrom.

The individual labels are typically defined by full perimeter die cuts which completely sever adjoining labels from their neighbors atop the continuous liner. By lifting the edge of an individual label, the label may be readily peeled away from the liner independently of adjacent labels, with the so removed label then being reattached to another surface using the same adhesive carried on the back of the label for effecting a bond therewith, which is typically permanent.

The adhesive must be suitably tailored in strength for maintaining integrity of the entire label sheet to prevent premature delamination of any of the individual labels thereon, while also permitting individual removal of the labels, with the perimeter die cuts preventing simultaneous multiple label removal.

It has been known to provide ties between adjoining labels, if it is desired to simultaneously remove two or more labels together. Several such ties may be spaced apart around the perimeter of adjoining labels so that removal of one label carries with it the so tied adjoining label in a serial strip of labels. The so removed individual labels may then be separated from each other by severing or tearing the joining ties.

It was also know to provide ties between labels used in simplex (single pass printing) applications in order to prevent delamination of labels. The problem primarily addressed there was extreme delamination, particularly of smaller labels provided with narrow feed strip caused by friction with the printer rollers (see U.S. Ser. No. 09/259,116, filed Feb. 26, 1999). The ties were thus only necessary on the smaller labels and only on the side first passing the printer roller.

In use, labels are printed for various reasons. For example, a pharmacy script is a specialized label sheet having differently sized and configured individual labels for different objectives. Relatively large labels may be used for identifying dispensed drugs and corresponding use instructions. Smaller labels may contain various warnings. And, an associated paper form integrated with the label sheet may include various information regarding the nature of the drug being dispensed and various instructions and warnings.

Pharmacy scripts are available in different configurations for various reasons. The primary objective of the pharmacy script is the labeling of prescription drug containers in a highly competitive industry. Since a typical pharmacy or drugstore dispenses a considerable volume of drug prescriptions each day, the pharmacy script must be easy and fast to use.

In one recently developed pharmacy script, several wide and narrow labels are formed laterally along a thin strip at the leading edge of the label sheet. The leading edge strip defines the feeding direction for the sheet and its orientation so that various information may be printed atop the various labels of the label sheet in the same configuration as multiple sheets are fed through a printer, such as a typical laser printer. In an initial prototype, the various labels contained full perimeter die cuts to ensure the individual removal thereof when desired. The individual labels must be readily removable without delay or damage to maximize the efficiency of label application to their containers.

It has been known to provide labels for duplex printing, i.e., printing on two sides by passing the media through the rollers, toner and fuser assembly twice. However, the additional heating by two runs through the fuser and the extra manipulation of the media needed to turn it around and run it through the printer process again exacerbated the delamination problem and the problem of adhesive coming off the media into the printer.

SUMMARY OF THE INVENTION

The inventors have discovered that, when pressure sensitive adhesive labels are used for duplexing applications, they are subject to move roller passes, e.g. de-curl bars, and to more heat than in simplex applications. For instance, prior to passing the de-curl station, the substrate passes through the fuser assembly which melts the toner for anchorage to the substrate. The heat indiscriminately softens the adhesive. This softening together with the stress applied as the substrate is manipulated at an acute angle throughout the printer, duplex unit, and de-curl station causes separation of labels at the die cuts and leakage of the adhesive to the surface. This separation exposes the adhesive to various parts in the printer path. This causes adhesive build-up in the printer and eventual undesired jamming, misfeeds and skewing. Such problems often put the machine out of service requiring attention by a trained service person. It can also damage the fuser assembly and duplex unit.

To avoid these disadvantages, the inventors have discovered that duplexing is improved by tying the die-cut pressure sensitive labels together, and/or to; edges, a matrix, waste strips etc., of the media. Tying the individual labels retains them in juxtaposition and keeps them from separating. The material therefore travels through the de-curl unit with labels intact and little or no leakage of adhesive into the printer. The ties can be strategically placed to fall directly in line with drive rollers within the printer. In order to improve the feed performance of die cut materials within a duplexing operation, during the die cutting process, a "tie" is added in one or more places to link the several die-cut shapes together. Creating a void or dull place within the cutting surface of the die is a preferred way to create a tie. The die cuts as it is designed, except in the void area, thus leaving an uncut section. The uncut section is the tie which continues to attach the individual die-cut sections. Ties prevent the die-cut sections from pulling apart and exposing adhesive within the printer.

According to the invention, the pressure sensitive label sheets, whether of the pharmacy script configuration described above, some other pharmacy script configuration or some other label application, are subject to duplex printing. As described above, the labels are accordingly provided with ties between the labels and other labels, the edges of the sheet, a matrix area, a waste area, etc., of the sheet. The ties are preferably provided by leaving a small area defining the tie not die cut. One or more ties can be provided for a particular label. In one embodiment, multiple ties are provided symmetrically spaced around the label. In another embodiment, one or more ties are provided only at the leading and trailing edges of the label, in terms of the direction of the sheet passing through the printer. In another embodiment, ties are strategically placed to coincide with where the drive rollers of the printer contact the sheet in order to provide additional stability where this friction occurs.

As described above, the invention is particularly useful when the adhesive used in connection with the labels is prone to softening when subject to the heat from the fuser in the printer, for example, at about 400–500° F. The ties keep the label in place, particularly as the sheet is subject to an acute angle to facilitate duplexing, so as to prevent the softened adhesive from leaking off the sheet onto the printer parts. However, the invention can also be applied in applications where the adhesive would not soften in the printer operation, e.g., in cold fuser assemblies or where non-melting adhesives are used. This is because the ties are useful also for preventing delamination which may occur due to the acute angle the sheet is subject to during duplexing.

The laser printers useful in connection with the tied labels of the invention include those known in the art and commercially available, including duplex printers manufactured by LexMark International, Lexington, Ky. The construction and operation of duplex printers are known in the art and need not be described here further.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

EXAMPLES

In the foregoing and in the following examples, all temperatures are set forth uncorrected in degrees Celsius, and unless otherwise indicated, all parts and percentages are by weight.

Figure 1:
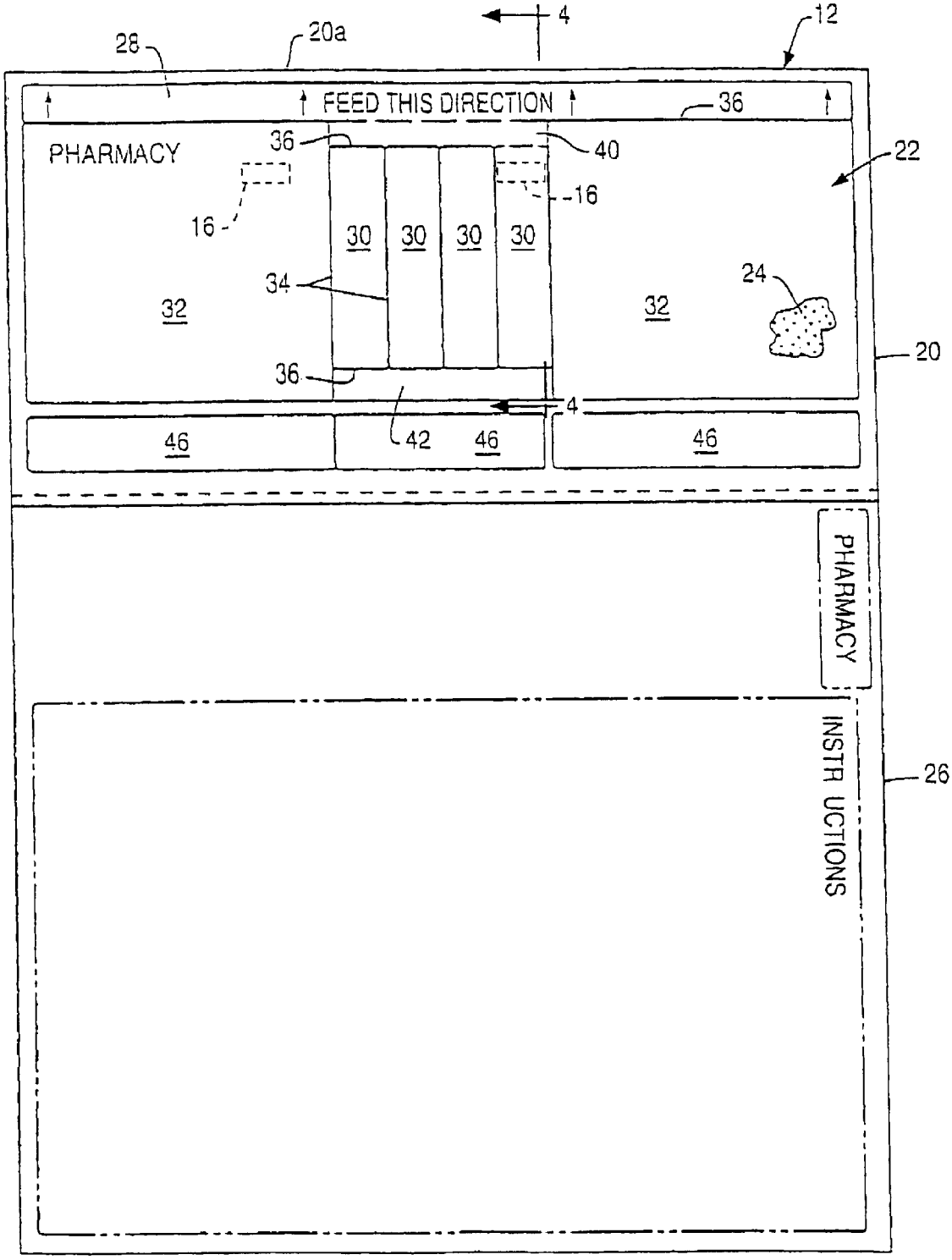
FIG. 1 is a top view of a label sheet configured in accordance with an exemplary embodiment of the present invention for travel through the laser printer.

An exemplary one of the label sheets of the invention is illustrated in FIG. 1 in front view in the form a specifically configured pharmacy script. The forward end of the label sheet is illustrated in more detail in FIG. 2.

The label sheet includes a release liner 20 which may have any conventional configuration and composition, and typically includes a silicone coated material having low adhesion capability. The liner 20 supports a face sheet or overlay 22 which is adhesively bonded thereto using a suitable adhesive 24 such as that typically used for pressure sensitive labels.

In the exemplary embodiment illustrated in FIG. 1, the label sheet 12 also includes an integrated paper form sheet 26 bonded to the liner 20 at a lap joint therebetween extending the full width of the sheet. The form sheet 26 may be configured for any useful purpose such as containing various printed information thereon for use in conducting a typical pharmaceutical prescription drug transaction.

Pharmacy scripts have enjoyed years of commercial use in the United States, and have various conventional constructions and configurations, with multiple pressure sensitive labels attached to a liner integrated with an attached form sheet. More specifically, the release liner 20 illustrated in FIG. 1 has a leading edge 20*a* which first travels through the corresponding path inside the printer 10. As used herein, leading edges are those edges which first travel along the feed path through the printer, with trailing edges being opposite edges along the travel or feed direction which last follow the corresponding leading edges through the printer.

With respect to FIG. 1, the liner leading edge 20*a* is disposed at the vertical top of the sheet and extends the full lateral or horizontal width therebetween. The trailing edge of the liner 20 overlaps and is suitably bonded to the leading edge of the form sheet 26, also along the entire width of the script. And, the form sheet 26 has a horizontal trailing edge which is disposed at the vertical bottom of the script.

The left and right side edges of the script extend vertically over its length, and define horizontally therebetween the width of the script. The script in the exemplary embodiment illustrated is rectangular, and is longer in length or height than it is wide. The exemplary rectangular script is 8.5 by 14 inches (21.6 cm by 35.6 cm) in height and width, respectively.

The label sheet includes a thin feed strip 28 which extends laterally across the liner 20 adjacent the leading edge 20*a* thereof. The thin feed strip 28 has a thickness or height of about 5 mm and extends substantially the full width of the liner. The feed strip 28, itself, has a leading edge slightly offset back from the leading edge of the liner by about 1 mm, for example, and also has a trailing edge.

Figure 3:
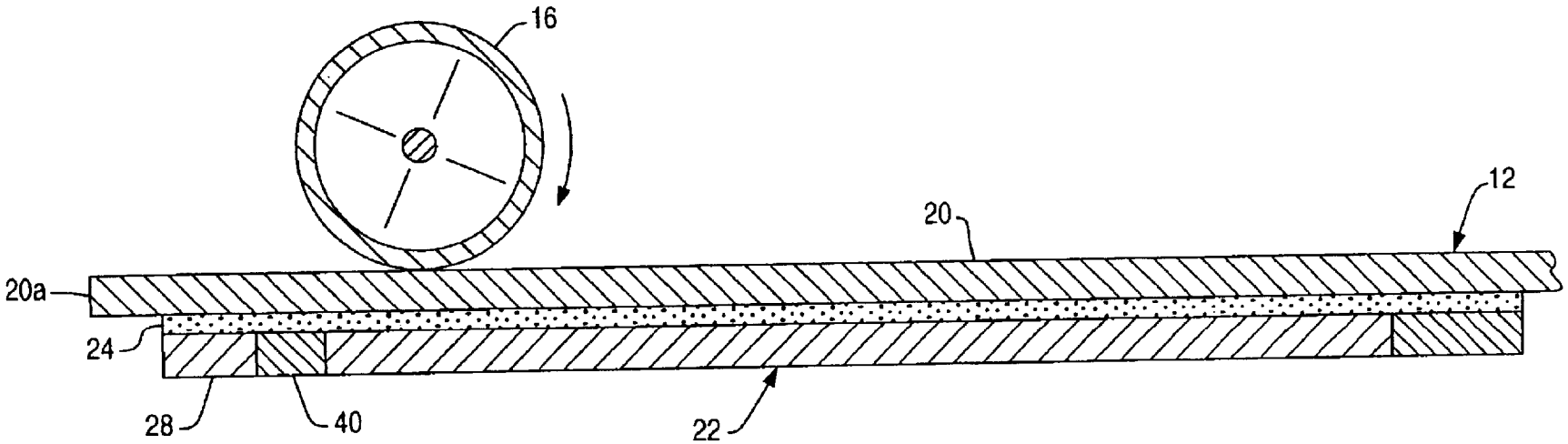
FIG. 3 is an enlarged, elevational sectional view through the forward portion of the label sheet illustrated in FIG. 1 and taken generally along line 4—4 positioned below a pickup roller of the printer.

The overlay 22 in the preferred embodiment illustrated in FIG. 3 has a plurality of laterally narrow labels 30 laterally adjoining each other, and which are laterally straddled by a pair of wide labels 32 extending laterally to the opposite left and right sides of the liner. The narrow labels 30 are about 12 mm wide, and relatively narrow compared to the wider labels 32 which are about 90 mm in width, for example. The narrow labels 30 are about 41 mm in length or height, as compared to the larger wide labels 32 which are 50 mm in height, for example.

Both the narrow and wide labels 30,32 laterally adjoin each other in turn along the length of the feed strip 28 over substantially the entire width of the liner. The feed strip and the labels are defined and severed from each other by corresponding die cuts including vertical die cuts 34 and horizontal die cuts 36. The die cuts 34,36 are conventionally formed using a sharp die blade which severs the overlay 22 down to but not including the underlying liner 22. The die cuts permit the individual removal of the labels from the liner by being peeled away therefrom, without adjoining labels being carried therewith. Each label must be separately removed for subsequent reattachment to another surface as desired using the same adhesive 24 coating the back sides thereof.

Figure 2:
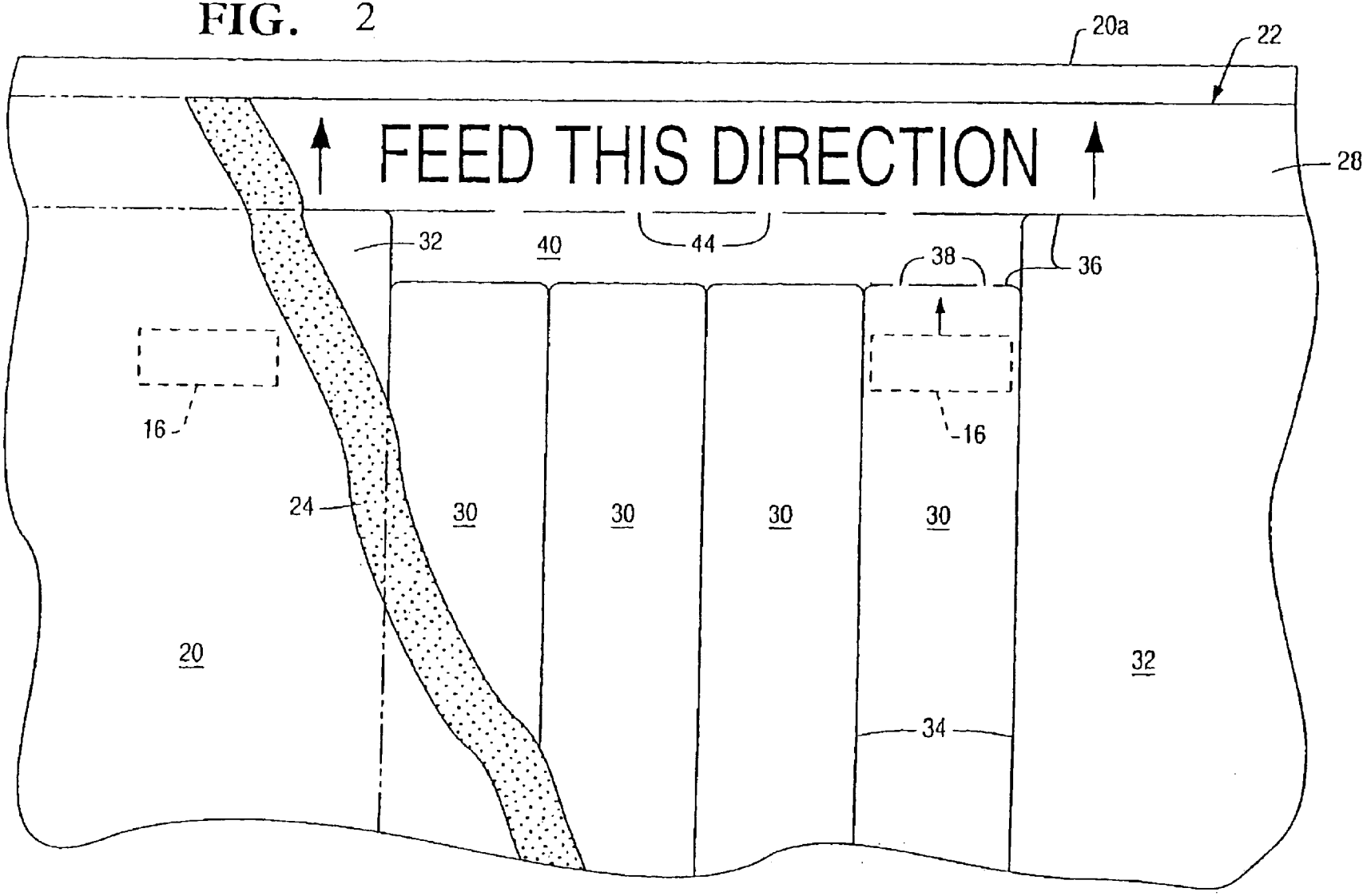
FIG. 2 is an enlarged view of the top center portion of the sheet illustrated in FIG. 1 in accordance with an exemplary embodiment.

FIG. 2 illustrates an enlarged view of the top center of the label sheet illustrated in FIG. 1. In the exemplary embodiment illustrated, there are four laterally adjoining narrow labels 30 straddled between the end two wide labels 32. The wide labels may be printed by the printer with any useful information regarding a typical prescription drug transaction such as an identification of the prescription and customer, and use instructions, with the labels being manually peeled from the liner 20 individually for reattachment around a prescription container (not shown) or packaging box. The four narrow labels 30 may have printed thereon additional information such as various warnings or use instructions, with each narrow label being individually removable for placement around the prescription container or its box.

The specific configuration of the pharmacy script illustrated in FIGS. 1 and 2 is controlled by its specific intended use. The script is a specialty configuration, having specially configured labels and form sheet. As a result thereof, the feed strip 28 contains a legend stating "FEED THIS DIRECTION" and corresponding arrows which point vertically upwardly along the height of the strip for ensuring the proper feeding of the script in the laser printer. The printer is software controlled by a corresponding computer which includes all the desired information being printed atop the script during a transaction.

The location of the two pickup rollers 16 from the printer are shown in phantom atop the script illustrated in FIG. 1. The pickup rollers 16 frictionally engage the back side of the liner 20 as illustrated in FIG. 3. One pickup roller 16 engages the liner at the leading edge of a first one of the narrow labels 30 as illustrated in FIG. 1, with other pickup roller 16 engaging the liner near the leading edge of one of the wide labels 32.

The first narrow label 30 illustrated in FIG. 2, directly adjoining the right wide label 32 has a leading edge die cut 36 with at least one interrupting label tie 38 therein for locally joining the narrow label to the feed strip 28. As shown in FIG. 2, the left pickup roller 16 is positioned behind the left wide label 32, whereas the right pickup roller 16 is positioned behind the first narrow label 30 directly adjoining the right wide label 32. Since ties are generally undesirable in the pharmacy script they are preferably not included therein except at limited locations in accordance with the present invention for solving the delamination problem experienced in the printer.

Accordingly, the pair of wide labels 32 have continuous die cuts along their leading edges where they adjoin the feed strip 28, without interruption therein or ties. The outboard edges of the wide labels and their trailing edges are exposed atop the liner 30 for permitting their ready removal without interference.

As shown in FIG. 1, and in more detail in FIG. 2, the four narrow labels 30 have full perimeter die cuts which are continuous, except for the first narrow label 30 behind which the right pickup roller 16 is positioned during feeding. The leading edge die cut 36 of the first narrow label 30 preferably includes a pair of the label ties 38 symmetrically disposed laterally therealong. For the exemplary 12 mm width of the narrow label 30, the individual label ties 38 each have a width therealong of slightly less than about 1 mm.

The vertical die cuts 34 extending along the full lengths of the narrow labels 30 between the adjoining narrow labels and the outboard wide labels 32 permit the individual removal of those labels without restraint by adjoining overlay material. Furthermore, the label ties 38 are sufficiently small for also permitting individual removal of the first narrow label 30 upon serving the ties 38, which readily occurs as the individual label is peeled away from the liner.

As shown in FIG. 2, the overlay preferably also includes a thin forward midstrip 40 which vertically adjoins the center portion of the feed strip 28, and vertically adjoins the center portion of the feed strip 28, and vertically adjoins the four narrow labels 30 laterally between the outboard wide labels 32. Since the narrow labels 30 are shorter in height than the adjoining wide labels 32, the mid-strip 40 at the top or forward end of the narrow labels permits those labels to be offset vertically between the leading and trailing edges of the outboard wide labels 32.

As shown in FIG. 1, a corresponding narrow, aft mid-strip 42 extends laterally along the trailing edges of the narrow labels 30 and adjoins the outboard wide labels 32, and shares a common trailing edged therewidth. The forward and aft mid-strips 40,42 maintain the continuity of the overlay 22 around the narrow labels 30 for maintaining label integrity during the manufacturing and printing process and have heights of 3 mm and 6 mm, respectively, for example.

The vertical die cuts 34, and the horizontal die cuts 36 define the perimeters of the several narrow labels 30 and wide labels 32 where they adjoin, as well as where they adjoin the forward mid-strip 40 and the feed strip 28. As shown in FIG. 2, the label ties 38 interconnect the first narrow label 30 and the forward mid-strip 40 for maintaining integrity therebetween during launching of the script through the printer by the pickup roller 16 therebehind.

The forward mid-strip 40 laterally adjoins the left side of the right wide label 32 as illustrated in FIG. 2 at the corresponding vertical die cut 34 threat. The forward mid-strip 40 itself, and both the wide labels 32 vertically adjoin the feed strip 28 along a common horizontal die cut 36 which extends between the left and right ends of the script. The common die cut 36 includes a plurality of strip ties 44 which are interruptions in the die cut for locally joining together the mid-strip 40 to the feed strip 28.

Like the label ties 38, the strip ties 44 are as narrow as possible and are less than about 1 mm for example to provide local ties between the two strips for preventing premature delaminating of the overlay material during travel through the printer. The strip ties 44 are preferably equally spaced apart from each other along the length of the forward mid-strip 40 at about 11 mm, for example. The strip ties 44 ensure integrity of the thin strip 28 and the thin forward mid-strip 40 as the label sheet is launched through the printer by the pickup rollers 16. The common die cut along the length of the feed strip 28 is continuous from end to end except for the four exemplary strip ties 44 at the forward mid-strip 40.

The label sheet 12 illustrated in FIG. 1 thusly incorporates a thin feed strip which offsets in the aft direction from the sheet leading edge the several narrow and wide labels 30,32 for maintaining their integrity during handling and traveling through the printer. Since the feed strip 28 is typically not used as a label itself, it is preferably as thin as practical, 5 mm for example, for protecting the leading edges of the wide labels 32 and maintaining integrity of the overlay.

The first narrow label 30 is positioned laterally atop the liner 20 for being in alignment with the corresponding pickup roller 16. And, the label ties 38, as illustrated in FIG. 2, are also aligned with the corresponding pickup roller 16 when the label sheet 12 is loaded into the paper tray, with the label ties 38 interconnecting the feed strip 28 to the first narrow label 30 through the intervening mid-strip 40.

The locally positioned pair of label ties 38 maintain integrity of the firs narrow label with the corresponding portion of the forward mid-strip 40. And, the additional strip ties 44 maintain integrity of the thin forward mid-strip 40 with the feed strip. In this way, the thin mid-strip 40 is interconnected with the feed strip 28 along its forward edge, and with the narrow labels 30 along its opposite aft edge, with the corresponding label and strip ties 38,44 providing structural ligaments.

In the exemplary embodiment illustrated in FIG. 1, a horizontal row of three laterally adjacent aft labels 46 is disposed below the narrow and wide labels and spaced therefrom atop the liner 20.

The selectively introduced ties 38,44 cooperating with the forward mid-strip and feed strip 28 in the various embodiments disclosed above ensures integrity of the label sheet 12 as it is transported through the printer, without premature delamination of any of the labels therefrom. Upon complete printing of the various labels on the script, the individual labels may then be separately removed without carrying therealong any of the adjacent labels, or without carrying the feed or mid-strips which remain attached to the liner 20. The first narrow label 30 may be readily removed from the liner by being peeled away therefrom preferably starting from its trailing edge which will readily sever the label ties 38 without otherwise tearing the label itself.

The entire disclosure of all applications, patents and publications, cited above is hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A label sheet for duplex printing which comprises at least one face sheet with two opposing printable sides, an adhesive layer bonded to the face sheet and at least one release liner removably adhered to the adhesive, said label sheet having at least one removably adhered label defined by a die cut through the face sheet to the adhesive around the perimeter of the label and at least one tie tying the label to another area on the face sheet, wherein duplex printing comprises printing on opposing sides of the label sheet and wherein printing on each side is accomplished by passing the label sheet through rollers and a toner and fuser assembly wherein the label sheet comprises two face sheets and two adhesive layers, one each on each side of the release liner.

2. A label sheet of claim 1, which comprises at least one label on each side of the sheet.

3. A label sheet for duplex printing which comprises a face sheet with two opposing printable sides, an adhesive layer bonded to the face sheet and a release liner removably adhered to the adhesive, said label sheet having multiple removably adhered labels defined by a die cut through the face sheet to the adhesive around the perimeter of said label, wherein each label has at least two ties defined by a portion of the perimeter of said label which is not die cut, with at least one tie on a leading edge of the label so as to correspond to where the drive rollers of the printer contact the label sheet and at least one tie on a trailing edge of the label so as to correspond to where the drive rollers of the printer contact the label sheet the leading and trailing edges being defined by the direction the label sheet would pass through a printer.

4. A label sheet of claim 3, wherein the label sheet comprises multiple labels on the face sheet and each label is provided with at least one tie on the leading edge which corresponds to where the drive rollers of the duplex printer contact the sheet.

5. A label sheet of claim 3, wherein the label sheet comprises multiple labels on the face sheet and each label is provided with at least one tie on the trailing edge which corresponds to where the drive rollers of the duplex printer contact the sheet.

6. A label sheet for duplex printing which comprises a face sheet with two opposing printable sides, an adhesive layer bonded to the face sheet and a release liner removably adhered to the adhesive, said label sheet having more than two removably adhered labels defined by a die cut through the face sheet to the adhesive around the perimeter of said label, wherein each of said labels has at least one tie defined by a portion of the perimeter of said label which is not die cut and wherein each label is provided with at least one tie on a leading edge of the label and at least one tie on a trailing edge of the label, the leading and trailing edges being defined by the direction the label sheet would pass through a printer.

7. A label sheet of claim 6, wherein each label is provided with a tie on the leading edge which corresponds to where the drive rollers of the duplex printer contact said label sheet and a tie on the trailing edge which corresponds to where the drive rollers of the duplex printer contact said label sheet, the leading and trailing edge being defined by the direction the label sheet would pass through a printer.

8. A label sheet for duplex printing which comprises a face sheet with two opposing printable sides, an adhesive layer bonded to the face sheet and a release liner removably adhered to the adhesive, said label sheet having more than two removably adhered labels defined by a die cut through the face sheet to the adhesive around the perimeter of said label, wherein each of said labels has at least one tie defined by a portion of the perimeter of said label which is not die cut and wherein the label is defined by a die cut through the face sheet to the adhesive around the perimeter of the label and the tie(s) are defined by portions around the perimeter of the label of a length less than 1 mm which are not die cut.

9. A label sheet for duplex printing which comprises a face sheet with two opposing printable sides, an adhesive layer bonded to the face sheet and a release liner removably adhered to the adhesive, said label sheet having more than three removably adhered labels defined by a die cut through the face sheet to the adhesive around the perimeter of said label, wherein each of said labels has at least two ties defined by a portion of the perimeter of said label which is not die cut, each tie having a length less than 1 mm, wherein each label has at least one tie positioned so as to correspond to where the drive rollers of the duplex printer contact said label sheet.

10. A label sheet of claim 9, wherein each label is provided with at least one tie on a leading edge of the label and at least one tie on a trailing edge of the label, the leading and trailing edges being defined by the direction the label sheet would pass through a printer.

11. A label sheet of claim 10, wherein each label is provided with a tie on the leading edge which corresponds to where the drive rollers of the duplex printer contact said label sheet and a tie on the trailing edge which corresponds to where the drive rollers of the duplex printer contact said label sheet, the leading and trailing edge being defined by the direction the label sheet would pass through a printer.

12. A label sheet of claim 9, wherein each label is provided with at least one tie on the leading edge of the label, the leading edge being defined by the direction the label sheet would pass through a printer.

13. A label sheet of claim 12, wherein at least one tie on the leading edge of each label corresponds to where the drive rollers of the duplex printer contact the sheet.

14. A label sheet of claim 9, wherein each label is provided with at least one tie on the trailing edge of the label, the trailing edge being defined by the direction the label sheet would pass through a printer.

15. A label sheet of claim 14, wherein at least one tie on the trailing edge of each label corresponds to where the drive rollers of the duplex printer contact the sheet.

16. A label sheet of claim 9, which additionally comprises a feed strip and at least two labels have at least one tie to said feed strip.

17. A label sheet for duplex printing which comprises a face sheet with two opposing printable sides, an adhesive layer bonded to the face sheet and a release liner removably adhered to the adhesive, said label sheet having more than two removably adhered labels defined by a die cut through the face sheet to the adhesive around the perimeter of said label, wherein each of said labels has at least one tie defined by a portion of the perimeter of said label which is not die cut; and wherein each label is provided with at least one tie on the trailing edge of the label, the trailing edge being defined by the direction the label sheet would pass through a printer.

18. A label sheet of claim 17, wherein each label has multiple ties on the trailing edge, evenly spaced from one another.

19. A label sheet of claim 17, wherein at least one tie on the trailing edge corresponds to where the drive rollers of the duplex printer contact the sheet.

* * * * *